US007628124B2

(12) United States Patent
Brückner et al.

(10) Patent No.: US 7,628,124 B2
(45) Date of Patent: Dec. 8, 2009

(54) STEAM GENERATOR IN HORIZONTAL CONSTRUCTIONAL FORM

(75) Inventors: Jan Brückner, Möhrendorf (DE); Joachim Franke, Altdorf (DE); Rudolf Kral, Stulln (DE)

(73) Assignee: Siemens Aktiengesellschaft, Munich (DE)

( * ) Notice: Subject to any disclaimer, the term of this patent is extended or adjusted under 35 U.S.C. 154(b) by 145 days.

(21) Appl. No.: 11/884,284

(22) PCT Filed: Feb. 10, 2006

(86) PCT No.: PCT/EP2006/050851

§ 371 (c)(1),
(2), (4) Date: Aug. 14, 2007

(87) PCT Pub. No.: WO2006/087299

PCT Pub. Date: Aug. 24, 2006

(65) Prior Publication Data

US 2008/0190382 A1 Aug. 14, 2008

(30) Foreign Application Priority Data

Feb. 16, 2005 (EP) ..... 05003268

(51) Int. Cl.
*F22B 1/18* (2006.01)

(52) U.S. Cl. ..... 122/470; 122/451 S; 122/425; 122/1 B

(58) Field of Classification Search ..... 122/1 B, 122/406.4, 32, 451 S, 448.4, 425, 426, 470
See application file for complete search history.

(56) References Cited

U.S. PATENT DOCUMENTS

| | | | | |
|---|---|---|---|---|
| 3,369,526 | A * | 2/1968 | Midtlyng | 122/406.4 |
| 3,927,646 | A * | 12/1975 | Dungey et al. | 122/6 A |
| 4,572,110 | A * | 2/1986 | Haeflich | 122/7 R |
| 5,660,799 | A * | 8/1997 | Motai et al. | 422/112 |
| 5,924,389 | A | 7/1999 | Palkes et al. | |
| 6,055,803 | A | 5/2000 | Mastronarde | |
| 6,189,491 | B1 | 2/2001 | Wittchow et al. | |
| 6,481,386 | B2 * | 11/2002 | Wittchow | 122/6 A |
| 6,536,380 | B1 * | 3/2003 | Kral et al. | 122/406.4 |
| 6,557,499 | B2 * | 5/2003 | Franke et al. | 122/1 B |
| 6,715,450 | B1 * | 4/2004 | Wittchow | 122/1 B |
| 7,428,374 | B2 * | 9/2008 | Franke et al. | 392/396 |
| 2007/0084418 | A1 * | 4/2007 | Gurevich | 122/1 B |

FOREIGN PATENT DOCUMENTS

| | | | |
|---|---|---|---|
| EP | 1 398 564 | A1 | 3/2004 |
| WO | WO 2004/025176 | A1 | 3/2004 |

* cited by examiner

*Primary Examiner*—Gregory A Wilson

(57) ABSTRACT

The invention relates to a steam generator whose continuously heating evaporator surface is arranged in a hot gas channel for a hot gas passage in a substantially horizontal direction and which comprises a plurality of steam generating pipes passed through by flowing medium, wherein a plurality of output collectors which are mounted downstream of certain steam generating pipes, on the side of flowing medium, are oriented in the longitudinal direction thereof substantially parallel to the hot gas direction. The invention improves the steam generator such that it is possible to attain a high operational flexibility, a particularly reduced start- and load-alternation time, including starting operation or light load phases and to maintain a low-cost production. Each output collector comprises an integrated water separating element by means of which said collector is connected, on the side of flowing medium, to a plurality of downstream arranged overheating pipes of an overheating surface.

10 Claims, 1 Drawing Sheet

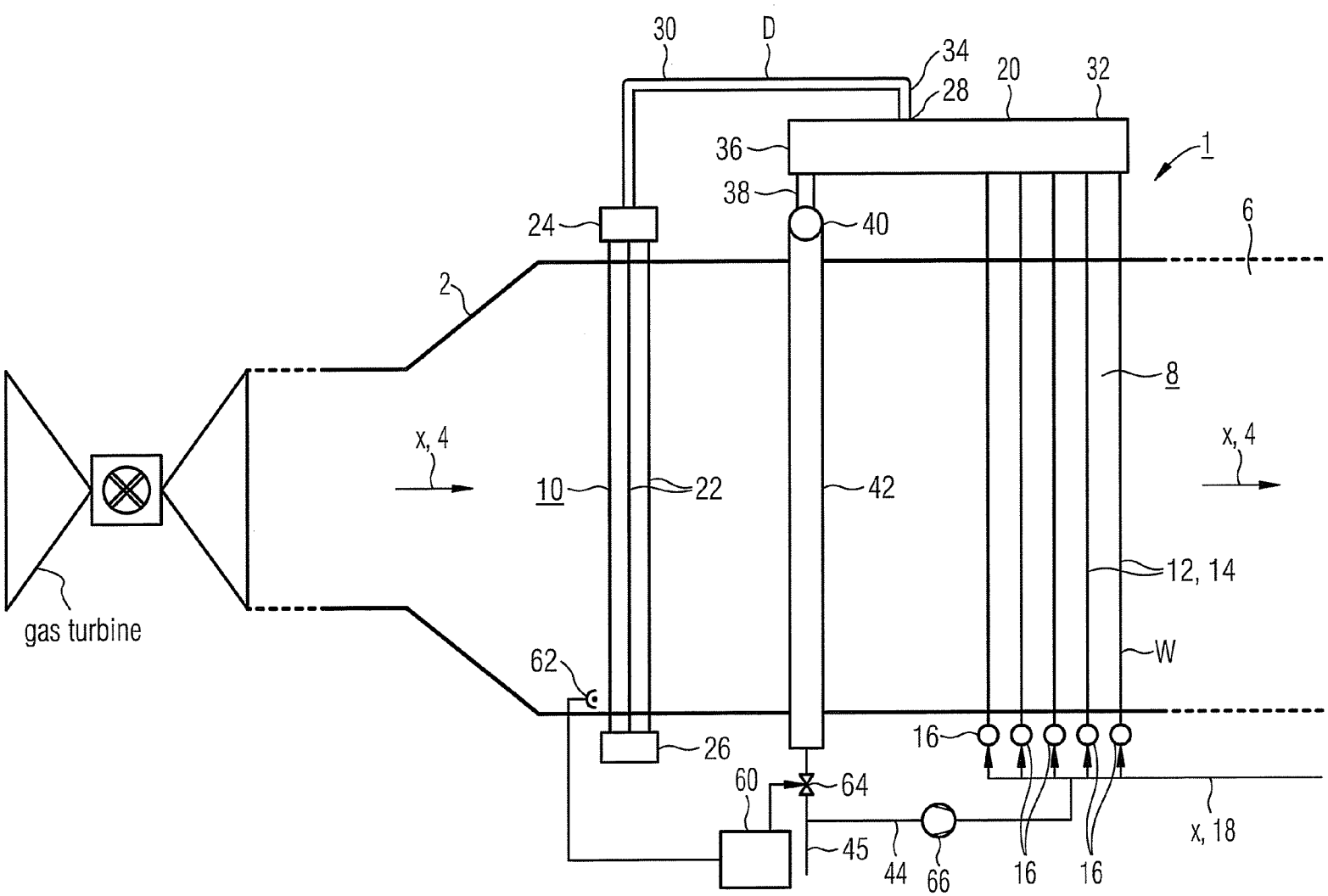
1
6
8
12, 14
W
x, 4
x, 18
32
20
34
28
16
16
16
66
44
45
64
40
42
D
36
38
60
30
22
26
24
10
62
2
x, 4
gas turbine

STEAM GENERATOR IN HORIZONTAL CONSTRUCTIONAL FORM

CROSS REFERENCE TO RELATED APPLICATIONS

This application is the US National Stage of International Application No. PCT/EP2006/050851, filed Feb. 10, 2006 and claims the benefit thereof. The International Application claims the benefits of European application No. 05003268.9 filed Feb. 16, 2005, both of the applications are incorporated by reference herein in their entirety.

FIELD OF INVENTION

The invention refers to a steam generator, in which an evaporative once-through heating surface is arranged in a hot gas passage which is exposable to through-flow in an approximately horizontal hot gas direction, which evaporative once-through heating surface comprises a number of steam generator tubes which are connected parallel to the through-flow of a flow medium, with a number of outlet headers which are connected downstream on the flow medium side to some steam generator tubes.

BACKGROUND OF THE INVENTION

In a gas and steam turbine plant, the heat which is contained in the expanded working medium or hot gas from the gas turbine, is used for producing steam for the steam turbine. The heat transfer is carried out in a heat recovery steam generator which is connected downstream to the gas turbine and in which a number of heating surfaces for water preheating, for steam generation and for steam superheating, are customarily arranged. The heating surfaces are connected into the water-steam cycle of the steam turbine. The water-steam cycle customarily comprises a plurality of pressure stages, for example, three, wherein each pressure stage can have an evaporative heating surface.

For the steam generator which, as a heat recovery steam generator, is connected downstream on the hot gas side to the gas turbine, a plurality of alternative design concepts, specifically the design as a once-through steam generator or the design as a recirculating steam generator, are a possibility. With a once-through steam generator, the heating of steam generator tubes, which are provided as evaporating tubes, leads to an evaporation of the flow medium in the steam generator tubes in a once-through passage. In contrast to this, with a natural or forced recirculation steam generator the water which is guided in the cycle is only partially evaporated during a passage through the evaporating tubes. The water which is not evaporated in this case, after separation of the generated steam, is fed again to the same evaporating tubes for further evaporation.

A once-through steam generator, in contrast to a natural or forced recirculation steam generator, is subjected to no pressure limitation, so that it can be designed for live steam pressures far above the critical pressure of water ($P_{Krit}$≈221 bar), where no distinction between the water and steam phases, and consequently also no phase separation, is possible. A high live steam pressure promotes a high thermal efficiency and consequently low $CO_2$ emissions of a fossil-heated power plant. Moreover, a once-through steam generator has a simple constructional form in comparison to a recirculating steam generator and consequently is producible at especially low cost. The use of a steam generator, which is designed according to the once-through principle, as a heat recovery steam generator of a gas and steam turbine plant, therefore, is especially favorable for achieving a high overall efficiency of the gas and steam turbine plant with a simple constructional form.

A heat recovery steam generator in horizontal constructional form offers special advantages with regard to production cost, but also with regard to necessary maintenance operations, in which heat recovery steam generator the heating medium or hot gas, that is the exhaust gas from the gas turbine, is guided in an approximately horizontal flow direction through the steam generator. Such a steam generator, which, with a design as a once-through steam generator with comparatively low structural and design cost, has an especially high degree of flow stability, for example is known from WO 2004/025176 A1. This steam generator has an evaporative once-through heating surface, which comprises a number of steam generator tubes or evaporating tubes which are connected parallel to the through-flow of a flow medium. In order to ensure in this case homogenization and stabilization of the flow conditions between evaporating tubes, which are arranged one behind the other when viewed in the hot gas direction, this once-through steam generator has a number of outlet headers which are connected downstream to the evaporative once-through heating surface and which with their longitudinal direction are oriented basically parallel to the hot gas direction, and so absorb the flow medium which flows from evaporating tubes which are arranged one behind the other, as seen in the hot gas direction, and which, therefore, are differently heated. These outlet headers of the evaporative once-through heating surface equally serve as inlet distributors for the downstream-connected superheater heating surface.

In general, a once-through steam generator is operated in low load mode or during starting with a minimum flow of flow medium in the evaporating tubes in order to ensure a safe cooling of the evaporating tubes and in order to avoid a possible steam formation in the economizer heating surface which is connected upstream on the flow medium side to the evaporative once-through heating surface. During starting or in low load mode, this minimum flow is not completely evaporated in the evaporating tubes, so that during such an operating mode still unevaporated flow medium is present at the end of the evaporating tubes. In other words, during this operating mode a water-steam mixture issues from the evaporating tubes. However, a distribution of such a water-steam mixture to superheater tubes, which customarily are connected downstream to the evaporating tubes, as a rule is not possible in the once-through steam generator; the distribution which is customarily provided rather presupposes that the flow medium which is to be distributed exclusively contains steam portions. Therefore, as a rule during starting or in low load mode of the once-through steam generator, a water-steam separation is necessary at the outlet of the evaporative once-through heating surface, which as a rule is carried out in so-called cyclone separators.

For design-related reasons, a through-feed of these cyclone separators with water is only possible to a limited degree. The heating surface which is usable for evaporation, therefore, has to lie upstream of the separators, as seen in the flow direction of the flow medium, and so is limited. This results in the live steam temperature being able to be controlled only within small limits by means of the feed water volume, wherein for a greater control range as a rule injection coolers are required. The limitation of the operational flexibility which is associated with these aspects, in addition to the high equipment cost, customarily as a rule gives rise to undesirably long starting times and reaction times during load changes of the once-through steam generator in low load mode.

SUMMARY OF INVENTION

The invention, therefore, is based on the object of disclosing a once-through steam generator of the aforementioned type, which with minimized production cost also enables an especially high operational flexibility in starting mode or low load mode, and consequently especially also enables minimized starting and load change times.

This object according to the invention is achieved by the outlet header, or each outlet header, comprising an integrated water separator element in each case, by means of which the respective outlet header is connected on the flow medium side to a number of downstream-connected superheater tubes of a superheater heating surface.

The invention in this case starts from the consideration that for achieving an especially high operational flexibility, also in the starting mode or low load mode, an especially large portion of the heating surfaces which are altogether available should be usable for evaporating purposes. In this case, a superheater heating surface, which is connected downstream to the evaporative once-through heating surface, should also be especially used for evaporating the flow medium when required, that is specifically for starting or low load purposes. The evaporation end point should be correspondingly shiftable into the superheater heating surface. In order to enable this, the transition region between the evaporative once-through heating surface and the subsequent superheater heating surface should be designed in such a way that a through-feed of water to the superheater heating surface is possible. With regard to the distribution problems which customarily accompany the through-feed of water, the water separating system which is connected between the evaporative once-through heating surface and the superheater heating surface, therefore, should be designed in such a way that a costly distribution is not required. This is achievable by the water separating system being decentrally designed, deviating from the central water-steam separation which is customarily provided, wherein the separating function is integrated in tube groups into a number of components which are connected in parallel and associated with individual tube groups. For this purpose, the outlet headers, which anyway for design-related reasons are associated in each case to one of only a small number of evaporating tubes, are provided with their longitudinal direction oriented in the hot gas direction.

The outlet headers in this case are advantageously designed for a water-steam separation, as required, according to the principle of inertia separation. In this case, the knowledge is used that on account of the significant inertia differences between steam on the one hand and water on the other hand, the steam portion of a water-steam mixture in an existing flow can be comparatively substantially more easily subjected to a deflection than the water portion. Especially during the integration of the water separating function in the outlet header, or headers, this can be implemented in an especially simple way by the respective outlet header being advantageously designed basically as a cylindrical body which by its end which is not connected to the steam generator tubes is connected to a water drain pipe section.

In a further advantageous development, in this case an outflow pipe section for flow medium branches off from the respective cylindrical body or from the respective water drain pipe section, and is expediently connected to a number of downstream-connected superheater tubes. In this development, the outlet header, which is provided with an integrated water separating function, is formed, therefore, basically in the fashion of a T-piece, in which the cylindrical body forms a basically rectilineal passage which is exposable to through-flow and in which the water portion of the flow medium is preferably guided on account of its comparatively higher inertia. The outflow pipe section branches off from this passage, into which outflow pipe section the steam portion of the flow medium is preferably deflected on account of its comparatively lower inertia.

The outlet headers, when viewed from above, are advantageously oriented with their longitudinal direction basically parallel to the hot gas direction, so that they absorb the flow medium which flows from evaporating tubes which are arranged one behind the other, as seen in the hot gas direction, and which, therefore, are differently heated. When viewed in the lateral direction, the outlet headers can also be oriented basically parallel to the hot gas direction. An especially high separating action, however, is achievable by the outlet header with integrated separating function being preferably designed on the one hand for the water portion of the flow medium being preferably guided on the inner wall of the cylindrical body which lies opposite the branching outflow pipe section, and on the other hand by the draining of the water being promoted. For this purpose, the cylindrical body and/or the water drain pipe section are advantageously arranged with their longitudinal direction inclined downwards in relation to the horizontal, as seen in the flow direction of the flow medium. The inclination in this case can also be comparatively sharply developed, so that the cylindrical body is basically perpendicularly oriented. In this case, the aforementioned inertia separation is still additionally promoted by means of the gravity effect on the water portion of the flow medium which flows in the cylindrical body.

An especially simple constructional form with regard to the flow guiding of the separated water is achievable by some or all of the water separator elements being advantageously connected on the water outlet side in groups to a common outlet header in each case, to which in turn a water collecting vessel is connected downstream in a further advantageous development.

During the separation of water and steam in the water separating system, either almost the whole water portion can be separated, so that only still evaporated flow medium is transmitted to the downstream-connected superheater tubes. In this case, the evaporation end point lies either still in the evaporating tubes or is fixed in the water separating system itself. Alternatively, however, only a part of the accumulating water can also be separated, wherein the residual still unevaporated flow medium is transmitted together with evaporated flow medium into the subsequent superheater tubes. In this case, which especially takes effect during the superposing of an additional cycle over the actual media flow in low load mode or starting mode, the evaporation end point is shifted into the superheater tubes.

In the last-named case, which is also referred to as overfeed of the separating unit, the components, like, for example, outlet headers or water collecting vessels, which on the water side are connected downstream to the water separator elements, are first completely filled with water, so that with further inflow of water a back pressure is formed in the corresponding pipe sections. As soon as this back pressure has reached the water separator elements, at least a partial flow of newly inflowing water, together with the steam which is carried along in the flow medium, is transmitted to the subsequent superheater tubes. In terms of volume, this partial flow corresponds in this case to the amount of water which cannot be absorbed by the components which on the water side are connected downstream to the water separator elements. In order to ensure an especially high operational flexibility in this operating mode of the so-called overfeeding of the separating system, a control valve, which is controllable by means of an associated control unit, is advantageously connected into a discharge line which is connected to the water collecting vessel. The control unit in this case is advantageously subjectable to an input value which is characteristic for the enthalpy of the flow medium at the outlet on the steam side of the superheater heating surface which is connected downstream to the water separating system.

By means of such a system, in the operating mode of the over-fed separating system the mass flow which flows from the water collecting vessel is adjustable by means of selective control of the valve which is connected into the discharge line of the water collecting vessel. Since this is compensated by a corresponding water mass flow from the water separator elements, the mass flow, which reaches the collecting system from the water separator elements, therefore, is also adjustable. Consequently, the remaining partial flow in turn is also adjustable, which together with the steam is transmitted into the superheater tubes, so that by means of a corresponding adjustment of this partial flow, for example at the end of the downstream-connected superheater heating surface, a predetermined enthalpy can be observed. The water partial flow, which together with the steam is transmitted to the superheater tubes, can also be alternatively or additionally influenced by means of a corresponding control of the superposed cycle. For this purpose, in a further or alternative advantageous development a circulating pump, which is associated with the evaporator tubes, is controllable by means of the control unit.

The respective outlet header, which is provided with an integrated water separating function, is advantageously designed for utilization of gravity force for facilitating the discharge of the separated water. For this purpose, the outlet header, or headers, is advantageously arranged above the hot gas passage.

An especially high operational stability of the steam generator is achievable by the evaporative once-through heating surface being designed for a self-stabilizing flow behavior when heating differences occur between individual steam generator tubes of the once-through heating surface. This is achievable by the evaporative once-through heating surface being designed in an especially advantageous development in such a way that one steam generator tube, which is heated more in comparison to a further steam generator tube of the same once-through heating surface, has a higher throughput of flow medium in comparison to the further steam generator tube. The evaporative once-through heating surface which is designed in such a way, therefore, demonstrates in the fashion of the flow characteristic of a natural recirculating evaporative heating surface (natural recirculating characteristic) a self-stabilizing behavior when different heating of individual steam generator tubes occurs, which behavior, without the need of external exertion of influence, also leads to an adjustment of the temperatures on the outlet side on differently heated steam generator tubes which are connected in parallel on the flow medium side.

The steam generator is expediently used as a heat recovery steam generator of a gas or steam turbine plant. In this case, the steam generator is advantageously connected on the hot gas side downstream of a gas turbine. With this connection, an additional firing for increasing the hot gas temperature can be expediently arranged behind the gas turbine.

The advantages which are achieved by the invention are especially that a decentrally designed water separating system can be made available by means of the integration of the water separating function in the outlet headers, in which on account of the small number of superheater tubes which are connected downstream to each individual water separator, a costly distribution system can be dispensed with. Consequently, a through-feed of unevaporated flow medium by means of the water separators is also possible, so that the evaporation end point can be shifted into the superheater tubes when required. Consequently, especially large portions of the heating surfaces are usable for evaporation purposes, particularly in starting mode and low load mode, wherein, moreover, an especially high operational flexibility is also achievable in these load states. Especially by means of the T-piece-like design of the outlet header as a cylindrical body with a branching outflow pipe section, moreover, a reliable water separation according to the principle of inertia separation can be achieved by simple means.

BRIEF DESCRIPTION OF THE DRAWINGS

An exemplary embodiment of the invention is explained in detail with reference to a drawing. In it, the FIGURE shows in a simplified view in longitudinal section the evaporative section of a steam generator in horizontal constructional form.

DETAILED DESCRIPTION OF INVENTION

The steam generator 1, which is shown in the FIGURE with its evaporative section, in the fashion of a heat recovery steam generator is connected downstream on the exhaust gas side to a gas turbine, which is not shown in detail. The steam generator 1 has a circumferential wall 2, which forms a hot gas passage 6 for the exhaust gas from the gas turbine, which hot gas passage is exposed to through-flow in an approximately horizontal hot gas direction x which is indicated by arrows 4. An evaporative once-through heating surface 8, which is designed according to the once-through principle, is arranged in the hot gas passage 6 and to which a superheater heating surface 10 is connected downstream for through-flow of a flow medium W, D.

The evaporative once-through heating surface 8 is subjectable to admission of unevaporated flow medium W, which in normal load mode or full load mode is evaporated during the once-through passage by means of the evaporative once-through heating surface 8, and after discharge from the evaporative once-through heating surface 8, is fed to the superheater heating surface 10 as steam D. The evaporative system, which is formed from the evaporative once-through heating surface 8 and the superheater heating surface 10, is connected into the water-steam cycle, which is not shown in detail, of a steam turbine. In addition to this evaporative system, a number of further heating surfaces, which are not shown in detail in the FIGURE, are connected into the water-steam cycle of the steam turbine, and which, for example, may be superheaters, medium pressure evaporators, low pressure evaporators and/or preheaters.

The evaporative once-through heating surface 8 is formed by means of a number of steam generator tubes 12 which are connected in parallel to the through-flow of the flow medium W. The steam generator tubes 12 in this case are oriented with their longitudinal axis basically vertical and designed for a through-flow of flow medium W from a lower inlet region to an upper outlet region, that is from bottom to top.

In this case, the evaporative once-through heating surface 8, in the fashion of a tube bundle, comprises a number of tube layers 14 which are arranged one behind the other, as seen in the hot gas direction x, of which each is formed from a number of steam generator tubes 12 which are arranged next to each other, as seen in the hot gas direction x, and of which only one steam generator tube 12 is visible in each case in the FIGURE. Each tube layer 14 in this case can comprise up to 200 steam generator tubes 12. In this case, a common inlet header 16, which is oriented with its longitudinal direction basically perpendicular to the hot gas direction x and arranged beneath the hot gas passage 6, is connected in each case upstream to the steam generator tubes 12 of each tube layer 14. Alternatively, a common inlet header 16 can also be associated with a plurality of tube layers 14. The inlet headers 16 in this case are connected to a water feed system 18 which is only schematically indicated in the FIGURE and which can comprise a distributing system for the need-based distribution of the inflow of flow medium W to the inlet headers 16. On the outlet side, and therefore in a region above the hot gas passage 6, the steam generator tubes 12 which form the evaporative once-through heating surface 8 lead into a number of associated outlet headers 20.

The superheater heating surface 10 is similarly formed by a number of superheater tubes 22. In the exemplary embodiment, these are designed for a through-flow of flow medium in the downwards direction, that is from top to bottom. On the inlet side, a number of distributors 24, which are designed as so-called T-distributors, are connected upstream to the superheater tubes 22. On the outlet side, the superheater tubes 22 lead into a common live steam header 26, from which the superheated live steam is feedable to an associated steam turbine in way which is not shown in detail. In the exemplary embodiment, the live steam header 26 is arranged beneath the hot gas passage 6. Alternatively, the superheater heating surface 10, however, could also be equipped with superheater tubes 22 which are constructed in a U-shape. In this case, which is not shown in detail in the FIGURE, each superheater tube 22 comprises in each case a down pipe section and a rising pipe section which is connected downstream to this, wherein the live steam header 26 as well as the outlet header 20 is arranged above the hot gas passage 6. In this case, a drain header can be connected between down pipe section and rising pipe section.

The evaporative once-through heating surface 8 is designed in such a way that it is suitable for a feed to, the steam generator tubes 12 with comparatively low mass flow density, wherein the flow conditions in the steam generator tubes 12 according to the design have a natural recirculation characteristic. With this natural recirculation characteristic, a steam generator tube 12 which is heated more in comparison to a further steam generator tube 12 of the same evaporative once-through heating surface 8, has a higher throughput of flow medium W in comparison to the further steam generator tube 12.

The steam generator 1 is designed for a reliable, homogeneous flow guiding with a comparatively simplified constructional form. In this case, the natural recirculation characteristic according to the design which is provided for the evaporative once-through heating surface 8 is consequently used for a simplified distribution system. This natural recirculation characteristic and the comparatively minimized mass flow density which is associated with it and provided according to the design, specifically enable the merging in a common space of the partial flows from steam generator tubes which are arranged one behind the other, as seen in the hot gas direction x, and which, therefore, are differently heated. While economizing on an independent, costly distribution system, therefore, a displacement of the mixing of the flow medium W, which flows from the evaporative once-through heating surface 8, into the outlet header 20, or outlet headers, is possible.

In order to impair as little as possible the homogenization, which is achieved in this case, of flow medium W which flows from steam generator tubes 12 which are differently positioned, as seen in the hot gas direction x, and which, therefore, are differently heated, during transmission to the subsequent system, each of the outlet headers 20, which are arranged basically parallel to each other and next to each other, and of which only one is visible in the FIGURE is oriented with its longitudinal axis basically parallel to the hot gas direction x. The number of outlet headers 20 in this case is matched to the number of steam generator tubes 12 in each tube layer 14, so that basically one outlet header 20 is associated in each case with the steam generator tubes 12 which are positioned one behind the other in each case and form a so-called evaporative plate. Similarly the distributors 24 are also oriented in each case with their longitudinal axis parallel to the hot gas direction x, so that one distributor 24 is associated in each case basically with the superheater tubes 22 which are positioned one behind the other in each case.

The steam generator 1 is designed for another additional recirculating mass flow of flow medium, in addition to the evaporable mass flow of flow medium, being able to be superposed on the steam generator tubes 12 when required for reasons of operational safety, especially in starting mode or low load mode. In order to ensure in this case an especially high operational flexibility, and, consequently, especially also minimized starting times and load change times, and to keep available an especially large portion of heating surfaces, it is provided that in this operating state the evaporation end point can be shifted when required from the steam generator tubes 12 into the superheater tubes 22. In order to enable this with comparatively minimized manufacturing cost, each of the outlet headers 20 comprises an integrated water separator element 28, via which the respective outlet header 20, via an overflow pipe 30, is connected on the flow medium side to one of the downstream-connected distributors 24. By means of this constructional form, it is especially ensured that after the water-steam separation, a costly distribution of water-steam mixture to the superheater tubes 22 is not necessary.

For a high separating action, with high operational reliability, the outlet headers 20, which are provided in each case with an integrated separating function, are designed on the concept of an inertia separation of a water-steam mixture. In this case, the knowledge is used that the water portion of a water-steam mixture flows straight on, preferably in its flow direction, at a branch point, on account of its comparatively greater inertia, whereas the steam portion is able to follow comparatively more easily a forced deflection on account of its comparatively lower inertia. In order to use this for an especially simple constructional form of the water separation, the outlet headers 20 are constructed in each case in the fashion of T-pieces, wherein an outflow pipe section 34 for flow medium, which leads into the associated overflow pipe 30 in each case, branches off from a basic body which is basically designed as a cylindrical body 32.

The basic body of the respective outlet header 20, which is designed as a cylindrical body 32, in this case is connected to a water drain pipe section 38 by its end 36 which is not connected to the steam generator tubes 12. By means of this constructional form, therefore, the water portion of the water-steam mixture in the outlet header 20 flows on, preferably in the axial direction, at the branch point of the outflow pipe section 34 which forms the respective integrated water separator element 28, and thus reaches the water drain pipe section 38 via the end 36. The steam portion of the water-steam mixture which flows in the cylindrical body 32, however, can better follow a forced deflection on account of its comparatively lower inertia, and thus flows via the outflow pipe section 34 and the further components which are connected in between, preferably to the downstream-connected superheater tubes 22. For boosting the separating action which is achieved in this case, and/or for facilitating water discharge, the cylindrical body 32 can be arranged with its longitudinal direction inclined downwards in the flow direction in relation to the horizontal.

On the water outlet side, that is via the water drain pipe sections 38, the water separator elements 28, which are integrated into the outlet headers 20, are connected in groups to a common outlet header 40 in each case. To this, a water collecting vessel 42, especially a separating vessel, is connected downstream. The water collecting vessel 42, via an associated discharge line 44, from which a drain line 45, which is connected to a drain system, also branches, is connected on the outlet side to the water feed system 18 of the once-through evaporative heating surface 8, so that a closed, operable recirculation cycle ensues. By means of this recirculation cycle, in starting mode, low load mode or partial load mode, an additional circulation for increasing the operational safety can be superposed on the evaporable flow medium which flows in the steam generator tubes 12. Depending upon operational requirement or demand, the separating system, which is formed by means of the integrated water separator elements 28, in this case can be operated in such a way that all the water which is still carried along at the outlet of the steam generator tubes 12 is separated from the flow medium and only evaporated flow medium is transmitted to the superheater tubes 22.

Alternatively, however, the water separating system can also be operated in the so-called overfed mode, in which not all the water is separated from the flow medium, but, together with the steam, another partial flow of the water which is carried along is transmitted to the superheater tubes 22. In this operating mode, the evaporation end point is shifted into the superheater tubes 22. In the overfed mode of this type, both the water collecting vessel 42 and the outlet header 40 which is connected upstream are first completely filled with water, so that a back pressure is formed up to the transition region of the respective water separator element 28 on which the outflow pipe section 34 branches off. Contingent upon this back pressure, the water portion of the flow medium which flows to the water separator elements 28 also at least partially experiences a deflection and thus reaches the outflow pipe section 34 together with the steam. The level of the partial flow, which in this case is fed together with the steam into the superheater tubes 22, is produced in this case on the one hand from the water mass flow which is altogether fed to the respective water separator element 28, and on the other hand from the partial mass flow which is discharged via the water drain pipe section 38. Thus, by means of suitable variation of the water mass flow which is fed and/or of the water mass flow which is discharged via the water drain pipe section 38, the mass flow of unevaporated flow medium which is transmitted to the superheater tubes 22 can be adjusted. Consequently, it is possible, by control of one or both of the aforementioned values, to adjust the portion of unevaporated flow medium which is transmitted to the superheater tubes 22 in such a way that, for example, a predetermined enthalpy at the end of the superheater heating surface 22 is established.

In order to enable this, a control unit 60 is associated with the water separating system and on the input side is connected to a sensor 62 which is formed for determining a characteristic value for the enthalpy at the end of the superheater heating surface 22 on the flue gas side. On the output side, the control unit 60 on the one hand acts upon a control valve 64 which is connected into the discharge line 44 of the water collecting vessel 42. Consequently, by selective control of the control valve 64, the water flow which is extracted from the separating system can be predetermined. This mass flow in the water separator elements 28 can be extracted in turn from the flow medium and transmitted to the subsequent collecting systems. Consequently, by control of the control valve 64, influencing of the water flow which is branched off in the water separator element 28 in each case, and therefore influencing of the water portion which, still in the flow medium after separation, is transmitted to the superheater heating surfaces 22, is possible. The control unit 60 can alternatively or additionally also act upon a circulating pump 68 which is connected into the discharge line 44, so that the flow rate of medium into the water separating system can also be correspondingly adjusted.

The invention claimed is:

1. A steam generator, comprising an evaporative once-through heating surface arranged in a hot gas passage which is exposed to an approximately horizontally oriented through-flow with respect to a hot gas flow direction, wherein the evaporative once-through heating surface comprises a plurality of steam generator tubes connected in parallel to the through-flow of a flow medium;

a plurality of outlet headers connected to the plurality of steam generator tubes, wherein each outlet header comprises an integrated water separator element having a steam side and a 1iquid side;

a plurality of superheater tubes that form a superheater heating surface where the plurality of superheater tubes are connected to the steam side of the water separator elements of the plurality of outlet headers, wherein each outlet header is constructed essentially as a cylindrical body having a connection to a water drain pipe at an end opposite the end connected to the steam generator tubes.

2. The steam generator as claimed in claim 1, wherein an outflow pipe section for the flow medium branches off from the respective cylindrical body or from the respective water drain pipe section.

3. The steam generator as claimed in claim 1, wherein the cylindrical body and/or the water drain pipe section are arranged with their respective longitudinal direction inclined downwards in the flow direction in relation to the horizontal.

4. The steam generator as claimed in claim 1, wherein at least some of the water separator elements are connected on the water outlet side in groups to a common outlet header in each case.

5. The steam generator as claimed in claim 4, wherein a water collecting vessel is connected downstream to the respective outlet header.

6. The steam generator as claimed in claim 5, wherein a control valve, which is controlled via an associated control unit is connected into a discharge line that is connected to the water collecting vessel, wherein the control unit receives an input value that is a characteristic for the enthalpy of the flow medium at the outlet on the steam side of the superheater heating surface which is connected downstream to the water separating system.

7. The steam generator as claimed in claim 6, wherein a circulating pump associated with the steam generator tubes is controlled via the control unit.

8. The steam generator as claimed in claim 1, wherein the outlet header, or each outlet header, is arranged above the hot gas passage.

9. The steam generator as claimed in claim 1, wherein the evaporative once-through heating surface is designed such that one steam generator tube which is heated more in comparison to a further steam generator tube of the same evaporative once-through heating surface has a higher throughput of flow medium in comparison to the further steam generator tube.

10. The steam generator as claimed in claim 9, wherein a gas turbine is connected upstream on the hot gas side to the hot gas passage.

* * * * *